US011090953B2

(12) United States Patent
Sawada

(10) Patent No.: US 11,090,953 B2
(45) Date of Patent: Aug. 17, 2021

(54) METHOD, SYSTEM, AND APPARATUS

(71) Applicant: CANON KABUSHIKI KAISHA, Tokyo (JP)

(72) Inventor: Hideharu Sawada, Nagareyama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/854,708

(22) Filed: Apr. 21, 2020

(65) Prior Publication Data

US 2020/0338910 A1 Oct. 29, 2020

(30) Foreign Application Priority Data

Apr. 25, 2019 (JP) ..... JP2019-084555

(51) Int. Cl.

*B41J 11/00* (2006.01)
*B41J 3/46* (2006.01)
*B41J 15/04* (2006.01)

(52) U.S. Cl.

CPC ..... *B41J 11/0065* (2013.01); *B41J 3/46* (2013.01); *B41J 11/003* (2013.01); *B41J 11/008* (2013.01); *B41J 15/04* (2013.01); *B41J 11/0025* (2013.01)

(58) Field of Classification Search

CPC ..... B41J 11/0065; B41J 11/003; B41J 11/008; B41J 3/46; B41J 15/04; B41J 11/0025

See application file for complete search history.

(56) References Cited

U.S. PATENT DOCUMENTS

2002/0130910 A1* 9/2002 Otsuki ..... B41J 2/04501 347/5
2013/0140754 A1* 6/2013 Nishiyama ..... B41J 13/12 271/2
2015/0002572 A1* 1/2015 Maeda ..... B41J 11/003 347/16

FOREIGN PATENT DOCUMENTS

JP 2017-65131 A 4/2017

* cited by examiner

*Primary Examiner* — Henok D Legesse
(74) *Attorney, Agent, or Firm* — Canon U.S.A., Inc. IP Division

(57) ABSTRACT

In a case where a predetermined sheet size is selected by a user from a plurality of sheet sizes displayed on a display, an image larger than the predetermined size is printed. In a case where a sheet size is input by the user in an input screen displayed on the display, an image having a size corresponding to the input sheet size is printed.

20 Claims, 11 Drawing Sheets

CUSTOM ROLL PAPER WIDTH SETTING DIALOG

FIG.5

211 206

| ROLL PAPER WIDTH ID | ROLL PAPER WIDTH NAME | SIZE |
|---|---|---|
| ID_17INCH_ROLL | 17-INCH ROLL PAPER (431.8mm) | 431.8 |
| ID_A2A3_ROLL | ISO A2/A3 ROLL PAPER (420.0mm) | 420.0 |
| ID_16INCH_ROLL | 16-INCH ROLL PAPER (406.4mm) | 406.4 |
| ID_14INCH_ROLL | 14-INCH ROLL PAPER (355.6mm) | 355.6 |
| ... | ... | ... |
| ID_CUSTOM_ROLL | CUSTOM ROLL PAPER | — |

FIG.6

| BORDERLESS PRINTING WIDTH |
| --- |
| 431.0 |
| 420.0 |
| 406.4 |
| 355.6 |
| . . . |

207

FIG.7

212

| | BORDERLESS PRINTING (EXTENSION PRINTING) | MINIMUM MARGIN PRINTING |
|---|---|---|
| 17-INCH ROLL PAPER (431.8mm) | ✓ | — |
| ISO A2/A3 ROLL PAPER (420.0mm) | — | ✓ |
| 16-INCH ROLL PAPER (406.4mm) | ✓ | — |
| 14-INCH ROLL PAPER (355.6mm) | — | ✓ |
| ... | ... | |

METHOD, SYSTEM, AND APPARATUS

BACKGROUND OF THE INVENTION

Field of the Invention

The aspect of the embodiments relates to a printing method, a printing system, and a printing apparatus to perform printing to the edge of a sheet.

Description of the Related Art

A printer performs "borderless printing" in which printing is performed to the edge of a sheet to print an image so that the image is printed to cover the sheet from edge to edge of the sheet without a margin at the edges of the sheet, in some cases. As a borderless printing method, there is a method in which a printer receives image data slightly larger than a sheet size from a printer driver, and performs printing by ejecting ink based on the data. According to the method, the printer ejects the ink to an area slightly wider than the sheet. Thus, even when a sheet conveyance error occurs in a width direction of roll paper, it is possible to prevent a margin from being generated at the end of the sheet. Further, to prevent a platen supporting the conveyed sheet from being stained by the ink ejected to the outside of the sheet in the borderless printing, an ink receiving hole to accommodate the ink is provided on the platen. This makes it possible to realize the borderless printing while preventing the platen from being stained.

Japanese Patent Application Laid-Open No. 2017-65131 discusses a method for obtaining a print result in which an image is printed to the edge of a minute margin by providing the minute margin by not ejecting ink to an area extending off the sheet in a case where no ink receiving hole is provided at the edges in the width direction of the sheet.

Assume that, as a printing method for the borderless printing, a print system determines whether to print a print image having a size extending off the sheet or to print the print image so as to provide the minute margin as discussed in Japanese Patent Application Laid-Open No. 2017-65131. At this time, for example, in a case where the determination is made based on the width of the roll paper used in printing and a static list representing the printing methods corresponding to respective roll paper widths, a new roll paper width is not included in the list. Thus, neither of the printing methods may be adopted for the roll paper having such a width, and the borderless printing may not be performed.

SUMMARY OF THE INVENTION

The aspect of the embodiments is directed to a technology that makes it possible to print an image to the edge of a sheet by a printing method suitable for various sheet sizes.

According to an aspect of the embodiments, a method includes displaying, as first displaying, a plurality of sheet sizes on a display, displaying, as second displaying, an input screen for inputting a sheet size, on the display, transmitting, by an information processing apparatus to a printing apparatus, print data and either one of sheet size information about a sheet size selected by a user from among the plurality of sheet sizes displayed in the first displaying and sheet size information about a sheet size input in the input screen displayed in the second displaying, and printing an image based on the transmitted print data, by a printing method for printing to an edge of a sheet, the method being changed based on the transmitted sheet size information. In a case where sheet size information about a predetermined sheet size selected from among the plurality of sheet sizes is transmitted, an image larger than the predetermined sheet size is printed, based on the print data. In a case where the sheet size information about the sheet size input in the input screen is transmitted, an image having a size corresponding to the sheet size information is printed, based on the print data.

Further features of the disclosure will become apparent from the following description of exemplary embodiments with reference to the attached drawings.

BRIEF DESCRIPTION OF THE DRAWINGS

FIG. 5 is a table illustrating information stored in a roll paper width list.

FIG. 6 is a table illustrating information stored in a borderless printing width list held by a host.

FIG. 7 is a table illustrating information stored in a borderless printing width list held by a printer.

DESCRIPTION OF THE EMBODIMENTS

Figure 1:
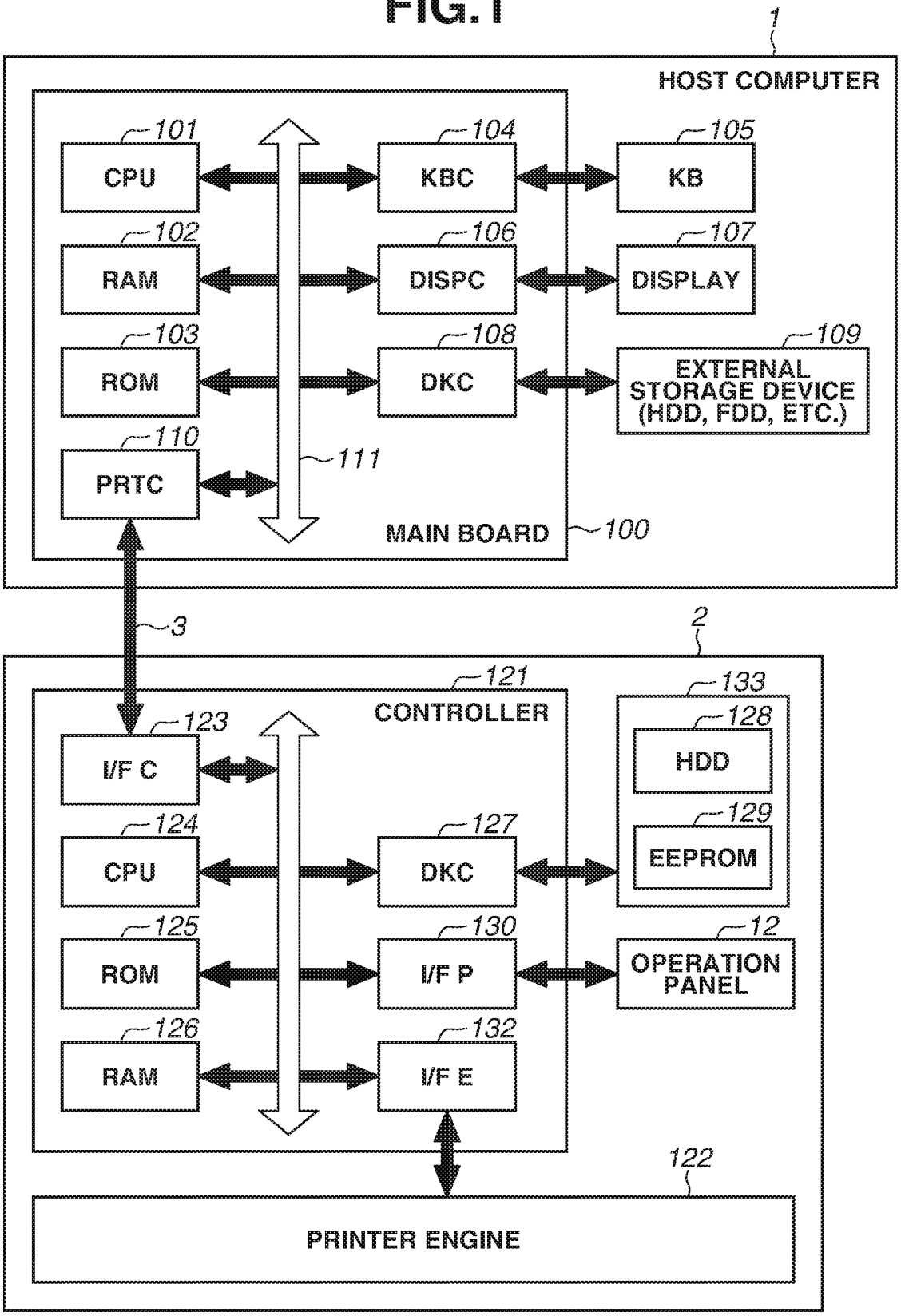
FIG. 1 is a system configuration diagram illustrating a printing system according to an exemplary embodiment.

An exemplary embodiment of the disclosure will be described in detail below with reference to accompanying drawings. The following exemplary embodiments do not limit the disclosure according to appended claims, and all of combinations of features described in the exemplary embodiment are not necessarily essential for solving means of the disclosure. The same components are denoted by the same reference numerals, and description of such components is omitted.

A printer driver according to the following exemplary embodiments creates a print image having a transverse width wider than a width of roll paper, and a printer realizes borderless printing by ejecting ink to an area extending off the edges of the roll paper in a width direction. In the following description, such a printing method is referred to as "extension printing". Even if a conveyance error occurs in a sheet width direction, the extension printing prevents a margin at the edge of the sheet from being generated, and an image can be printed to the edge of the sheet.

Further, the printer in the following exemplary embodiments can perform minimum margin printing that realizes the borderless printing, by providing a minute margin at the edges of the roll paper in the width direction without ejecting the ink to the area extending off the edges of the roll paper in the width direction. The margin at this time is determined by the printer so as to be sufficiently smaller than a margin in a case where bordered printing is performed. Accordingly, the minimum margin printing also makes it possible to print the image to the edge of the sheet.

In the following exemplary embodiment, a roll paper width compatible with the borderless printing (extension printing or minimum margin printing) is determined based on a roll paper width list held by both the printer driver and the printer. The printer driver generates a print image for the extension printing to be performed on the paper with the roll paper width, based on a width and a height of an output sheet size and the roll paper width list. More specifically, the printer driver changes the magnification of an image corresponding to data created by an application to the roll paper width set in print settings, and generates the print image slightly extending off the edges of the roll paper in the width direction. The printer driver then transmits, to the printer, a print job that includes the print image and the print settings representing that the borderless printing is set. At this time, in a case where there is a roll paper width for which the borderless printing can be feasible through rotation of the image by 90 degrees, the printer driver may rotate the image by 90 degrees and generate the print image. In addition, the printer compares a sheet size in the print settings (or size of print image itself) included in the print job received from the printer driver with the roll paper width list. The printer then switches the minimum margin printing and the extension printing based on a result of the comparison, thus performing the borderless printing.

In the following exemplary embodiments, a technique for realizing the borderless printing suitable for a roll paper with a custom width optionally designated by a user in addition to the roll paper included in the above-described list, is further described.

A configuration of a computer apparatus according to an exemplary embodiment will be described below with reference to a block diagram of FIG. 1. FIG. 1 is a system configuration diagram illustrating a printing system according to the present exemplary embodiment. FIG. 1 schematically illustrates a print system that includes a host computer (hereinafter, host) 1 serving as an information processing apparatus, and an inkjet printer (hereinafter, printer) 2 serving as a printing apparatus.

As illustrated in FIG. 1, the host 1 and the printer 2 are connected so as to perform bidirectional communication through a predetermined bidirectional interface 3 (e.g., universal serial bus (USB), or transmission control protocol/internet protocol (TCP/IP)). Major examples of the host 1 include a personal computer (PC).

The host 1 includes a main board 100 including a CPU 101, a keyboard (KB) 105, a display (DISPLAY) 107, such as a liquid crystal display (LCD), and an external storage device 109, such as a hard disk drive (HDD) and a flexible disk (FDD). The main board 100 further includes a random access memory (RAM) 102, a read-only memory (ROM) 103, a keyboard controller (KBC) 104, a display controller (DISPC) 106, a disk controller (DKC) 108, and a printer controller (PRTC) 110.

The CPU 101 totally controls the above-described components connected to a system bus 111 and executes various kinds of programs. The keyboard controller 104 controls input from the keyboard 105 and a pointing device (not illustrated). The keyboard controller 104 is also referred to as an operation unit or an input unit. The display controller 106 controls display of the display 107. The RAM 102 functions as a main memory or a work area of the CPU 101. The ROM 103 stores an operating system, programs executing the respective functions including a printer driver (described below) according to the present exemplary embodiment, a boot program, various applications, a printer control command generation program (hereinafter, printer driver), etc. The disk controller 108 controls access to the external storage device 109, such as a hard disk drive and a flexible disk. The printer controller 110 is connected to the printer 2 through the bidirectional interface 3, and controls communication processing of data and commands with the printer 2.

The printer 2 includes a controller 121, a printer engine 122, an operation panel 12, and a nonvolatile storage device 133, and is connected to the host 1 through the bidirectional interface 3. The nonvolatile storage device 133 includes a hard disk drive (HDD) 128 or an electrically erasable programmable read-only memory (EEPROM) 129. The nonvolatile storage device is also referred to as a nonvolatile memory. The controller 121 includes a CPU 124, a ROM 125, a RAM 126, an interface controller (I/FC) 123, a disk controller (DKC) 127, a panel interface (I/FP) 130, and an engine interface (I/FE) 132. The CPU 124 executes various programs. The ROM 125 receives a print command and print image data corresponding to a print image from the host 1, controls the printer engine 122, and stores programs and various types of data for appropriate printing. The RAM 126 is used as a work area that temporarily stores the various types of data and the various programs. The interface controller 123 is connected to the host 1 through the bidirectional interface 3, and controls communication processing of data and commands with the host 1. The HDD 128 stores a large amount of data, such as data from the host 1 and ancillary information about the data. The EEPROM 129 stores information unique to the recording device that is used in recording operation. The disk controller 127 controls access to the nonvolatile storage device 133. The panel interface 130 controls display of the operation panel 12 and input from the operation panel 12. The engine interface 132 directly controls the hardware, thus controlling the printer engine 122 that realizes appropriate recording.

In the present exemplary embodiment, a printer engine using an inkjet recording method is used as the printer engine 122; however, a printer engine using an electrophotographic method or an offset printer may be used.

Figure 2:
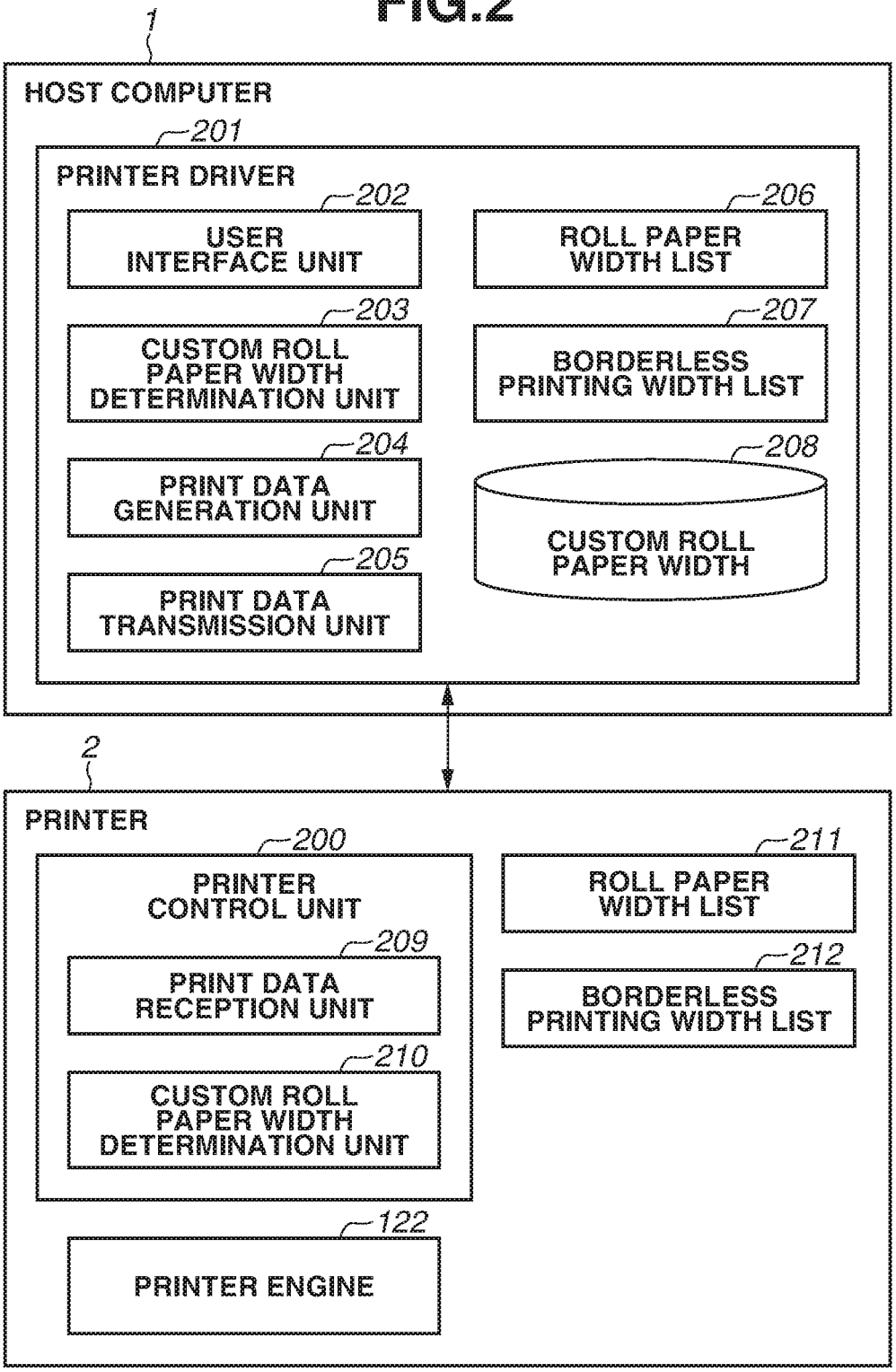
FIG. 2 is a functional block diagram illustrating a functional configuration of a printing control apparatus according to the exemplary embodiment.

FIG. 2 is a functional block diagram illustrating a functional configuration of the printing control apparatus according to the present exemplary embodiment. The host 1 according to the present exemplary embodiment includes a printer driver 201 in the ROM 103, and the printer driver 201 includes some functional units and some information storage units. These functional units are included as program modules in the printer driver 201, and functions of the respective functional units are realized when the CPU 101 executes these program modules. To simplify the description, the following description will be provided as if not the CPU 101 but the printer driver 201 or each of the functional units in the printer driver 201 mainly realizes the function, in some cases.

A user interface unit 202 has the function of providing a user interface enabling a user to input print settings of the printer driver. When an application issues an instruction to activate the printer driver 201, to the operating system (OS), the OS activates the printer driver 201. The printer driver 201 uses the function of the user interface unit 202 to display a print setting screen on the display 107, based on an instruction to display the print setting screen from the OS. The user interface unit 202 previously internally holds information about the functions of the printer 2, and displays the print setting screen based on the information. The information about the functions of the printer 2 is, for example, capability information representing functions settable to the printer 2. The capability information includes, for example, a printable sheet size, a sheet type, and a print mode relating to a printing speed and printing quality. Further, the print setting screen is displayed such that various types of image processing executable by the printer driver 201 can be designated.

Figure 3:
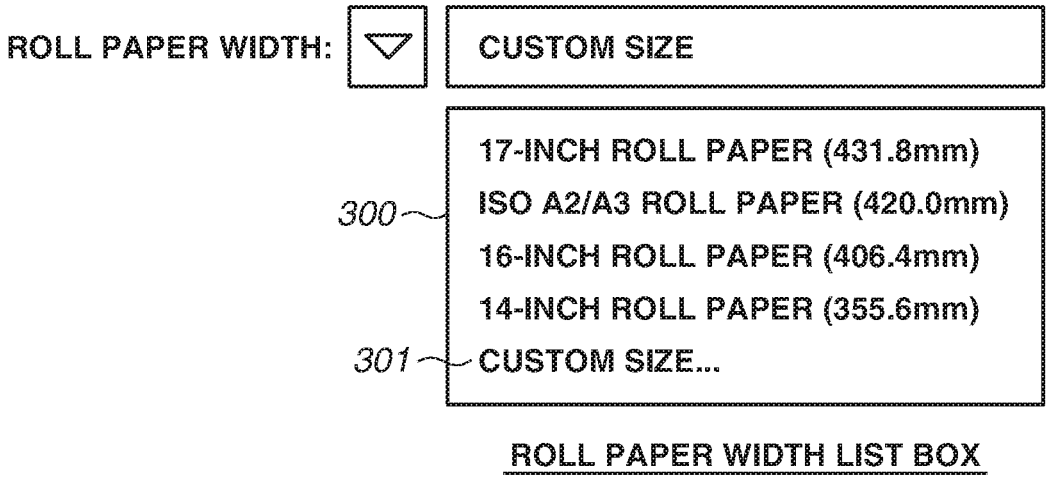
FIG. 3 is a diagram illustrating a roll paper width list box.

For a function relating to a roll paper width, the user interface unit 202 displays a roll paper width list box 300 illustrated in FIG. 3, on the display 107. The roll paper width list box 300 is displayed based on a roll paper width list 206 illustrated in FIG. 5 and a borderless printing width list 207 illustrated in FIG. 7. The roll paper width list 206 and the borderless printing width list 207 are stored in, for example, the ROM 103 or the external storage device 109 so as to be referred by the printer driver 201 when the printer driver 201 is installed in the host 1.

FIG. 5 is a table illustrating information stored in the roll paper width list 206. Information about regular roll paper widths supported by the printer 2 is stored in the roll paper width list 206. More specifically, a roll paper width identification (ID) to be internally handled by the printer driver 201 and a character string (text) used by the user interface unit 202 for display, and the size of the roll paper width are stored.

FIG. 6 is a table illustrating information stored in the borderless printing width list 207 held by the printer driver 201. Among the regular roll paper widths supported by the printer 2 (roll paper widths included in roll paper width list 206), information about roll paper widths compatible with the borderless printing is stored in the borderless printing width list 207. In the present exemplary embodiment, the roll paper width list 206 and the borderless printing width list 207 are separate; however, the roll paper width list 206 and the borderless printing width list 207 may be held as one list.

As illustrated in FIG. 5, information representing a custom roll paper width is included in the roll paper width list 206, in addition to the information about the regular roll paper widths supported by the printer 2. A text used for selecting the custom roll paper width is included in the roll paper width list box 300. When the user selects the text for selecting the custom roll paper width, the user can input a new roll paper width not included in the roll paper width list box 300.

As illustrated in FIG. 6, the information about the roll paper widths compatible with the borderless printing among the roll paper widths supported by the printer 2 is exhibited in the borderless printing width list 207. In a case where the printer 2 can perform the borderless printing by the minimum margin printing, the printer driver 201 can generate a print image for the borderless printing for each of the regular roll paper widths. Accordingly, in the present exemplary embodiment, the same roll paper widths are listed in the roll paper width list 206 and the borderless printing width list 207. If the roll paper width for which the borderless printing is prohibited is present in the printer 2, the borderless printing width list 207 illustrated in FIG. 7 may be created with that roll paper width being excluded. Detailed information about the roll paper width list 206 and the borderless printing width list 207 will be described below.

Figure 4:
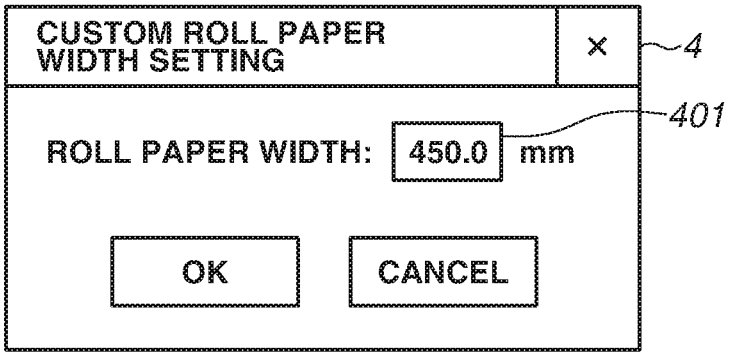
FIG. 4 is a diagram illustrating a dialog to set a custom roll paper width.

In a case where the user selects a custom size in the roll paper width list box 300, the user interface unit 202 displays an input screen that enables the user to input an optional roll paper width, illustrated in FIG. 4, on the display 107. A sheet size (roll paper width) input in the input screen is stored in the custom roll paper width in the roll paper width list 206.

A custom roll paper width determination unit 203 determines whether the roll paper width currently set as the print setting in the printer driver 201 is the custom roll paper width.

A print data generation unit 204 generates a print job that includes print data (print image) and a print command including the print settings. More specifically, the print data generation unit 204 converts a format of data to be printed, such as a document prepared by the user, into a data format interpretable by the printer 2, based on the print settings set with the user interface unit 202. The print data generation unit 204 then generates the print job including data (print image) for which the data format has been converted and a print command for printer control. At this time, the above-described data to be printed is a document generated by an application, and an image managed and edited by an application, for example. When the user designates the printer driver 201 and issues instruction to perform printing in the user interface provided by the application, the data to be printed is output to the OS. The data to be printed is then converted into intermediate data by the OS, and the converted intermediate data is input to the printer driver 201. The printer driver 201 performs, on the input data to be printed (intermediate data), rasterization, color conversion into a color space corresponding to the printer 2, and conversion from a multivalued image data into binary print data, for example. The print data generated in this manner is included in the print job.

A print data transmission unit 205 transmits the print job generated by the print data generation unit 204, to the printer 2.

The printer 2 includes a printer control unit 200 and a printer engine 122. The printer control unit 200 includes a print data reception unit 209 and a custom roll paper width determination unit 210. The print data reception unit 209 and the custom roll paper width determination unit 210 are stored as program modules in the ROM 125, and the CPU 124 executes these program modules. Thus, the CPU 124 functions as the print data reception unit 209 and the custom roll paper width determination unit 210. Alternatively, circuits (hardware) corresponding to the print data reception unit 209 and the custom roll paper width determination unit 210 may be included in the printer control unit 200.

The print data reception unit 209 performs reception control to cause the interface controller 123 to receive the print job transmitted from the print data transmission unit 205. The custom roll paper width determination unit 210 determines whether a command representing the custom roll paper width is included in the print job received by the print data reception unit 209. Details of the determination made by the custom roll paper width determination unit 210 will be described below.

The information about the regular roll paper widths supported by the printer 2 is exhibited in a roll paper width list 211. The contents of the roll paper width list 211 are the same as the contents of the roll paper width list 206 which is referred by the printer driver 201. Further, among the roll paper widths supported by the printer 2, information about the roll paper widths compatible with the borderless printing by the extension printing and information about the roll paper widths compatible with the borderless printing by the minimum margin printing are exhibited in a borderless printing width list 212. The printer 2 is designed such that, when the roll paper width compatible with the borderless printing by the extension printing is used, a platen (member supporting sheet in printing) included in the printer 2 is not stained by ink ejected to a position beyond the edges of the roll paper in the width direction for the extension printing. More specifically, an ink receiving hole that accommodates the ink ejected to the area extending off the edges of the roll paper in the width direction is provided at the position corresponding to the roll paper width.

FIG. 7 is a table illustrating the information stored in the borderless printing width list 212 held by the printer 2. The table lists information representing whether the borderless printing by the extension printing is performed and information representing whether the borderless printing by the minimum margin printing is performed, for each of the roll paper widths. In the present exemplary embodiment, the borderless printing width list 212 is illustrated as one list; however, the information representing whether the borderless printing by the extension printing is performed and the information representing whether the borderless printing by the minimum margin printing is performed may be held as separate lists by the printer 2.

Although separately called for description in the present exemplary embodiment, the roll paper width list 206 held by the printer driver 201 and the roll paper width list 211 held by the printer 2 include equivalent information. Details of the information held by each of the lists will be described below.

FIG. 3 illustrates an example of a screen for selecting the roll paper width, in the printer driver provided by the user interface unit 202. As a plurality of display items corresponding to sheet sizes, a plurality of texts representing the respective roll paper widths are displayed in the roll paper width list box 300. In a case where the borderless printing has been set, the roll paper width list 206 and the borderless printing width list 207 are compared, and only the roll paper widths for which the borderless printing is feasible among the roll paper widths included in the roll paper width list 206 are displayed in the list of the roll paper width list box 300. In the present exemplary embodiment, a description will be provided using an example in which all of the roll paper widths in the roll paper width list 206 are included in the borderless printing width list 207, and all of the roll paper widths in the roll paper width list 206 are displayed in the roll paper width list box 300 illustrated in FIG. 3. In a case where only a part of the roll paper widths included in the roll paper width list 206 is included in the borderless printing width list 207, the roll paper widths displayed on the screen in FIG. 3 are changed depending on whether the borderless printing has been designated on the print setting screen provided by the user interface unit 202.

In contrast, in a case where the borderless printing has not been designated, all of the roll paper widths included in the roll paper width list 206 are displayed in the list of the roll paper width list box 300. A text "custom size" 301 is a display item for designation of the optional roll paper width, and is always displayed in the list of the roll paper width list box 300 irrespective of whether the borderless printing has been designated.

FIG. 4 is a diagram illustrating a dialog (input screen) to set the custom roll paper width. In a case where the text "custom size 301" is selected in the roll paper width list box 300, the user interface unit 202 displays the dialog illustrated in FIG. 4 as an input screen that enables the user to input an optional sheet size (roll paper width). The user inputs the optional roll paper width in a roll paper width edit box 401 of a displayed custom roll paper width setting dialog 4, setting the custom roll paper width.

When the roll paper width is input in the roll paper width edit box 401 illustrated in FIG. 4, the roll paper width is adopted to the print settings. A print image corresponding to the input roll paper width is generated, and a print job that includes the print image and the print settings representing the input roll paper width is transmitted to the printer 2. The input roll paper width may be stored in a "size" corresponding to a new roll paper width ID in the roll paper width list 206 illustrated in FIG. 5. Accordingly, when the screen illustrated in FIG. 3 is displayed again, the user can select the roll paper width without inputting the roll paper width. In such a case, the printer 2 that has received the print job adds the roll paper width also to the roll paper width list 211, and adds the roll paper width in the borderless printing width list 212, as the roll paper width compatible with the minimum margin printing.

Figure 8:
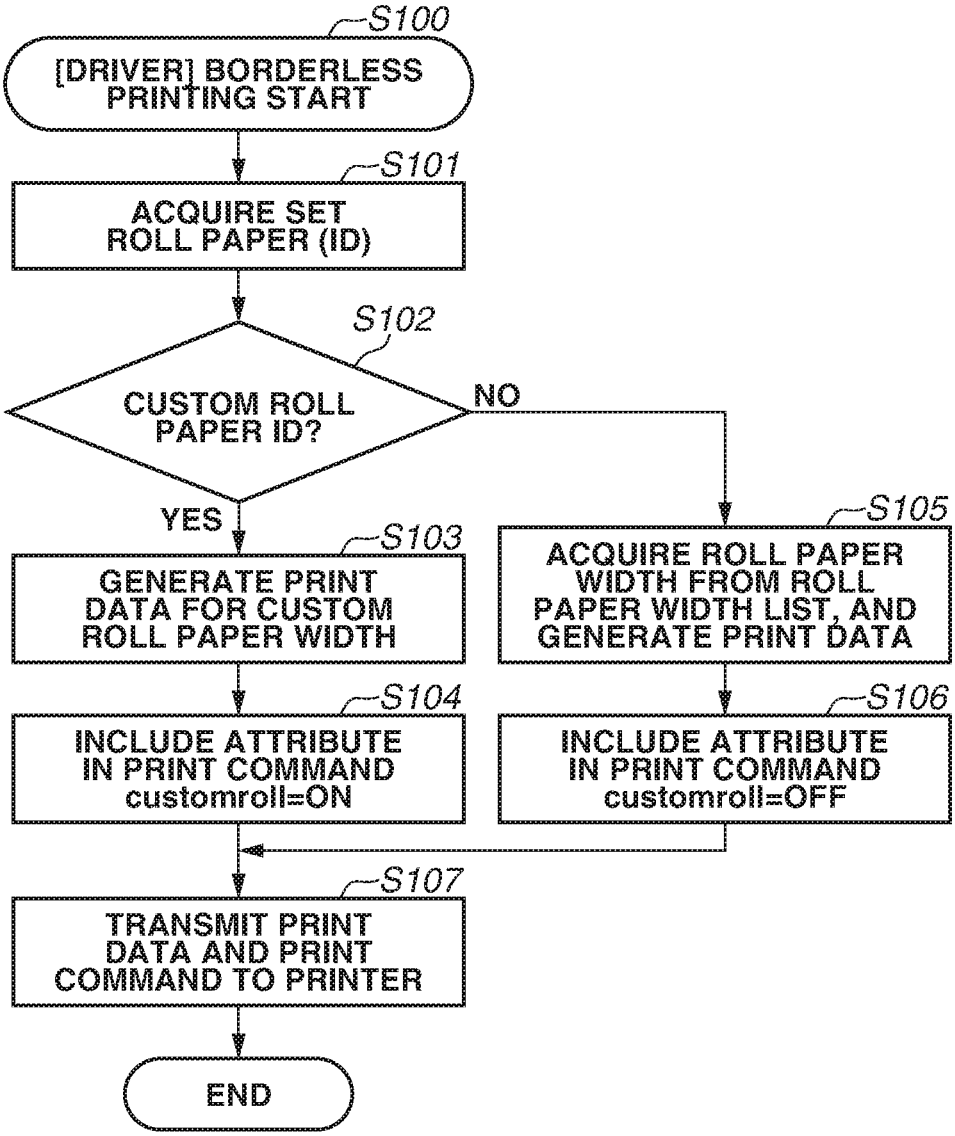
FIG. 8 is a flowchart illustrating an example of processing which is performed by a printer driver.

FIG. 8 is a flowchart illustrating an example of processing which is executed by the printer driver in executing roll paper width enlarged borderless printing. The processing illustrated in FIG. 8 is realized when the CPU 101 executes, on the RAM 102, the program modules corresponding to the respective functional units included in the printer driver 201. Here, a description will be provided assuming that each of the functional units of the printer driver 201 mainly perform the processing. Further, the processing illustrated in FIG. 8 is executed in a case where the user issues printing instruction in a state where the borderless printing has been designated in the print settings in the user interface provided by the printer driver 201.

First, in step S101, the custom roll paper width determination unit 203 of the printer driver 201 acquires a roll paper width ID set in the roll paper width list box 300. More specifically, the custom roll paper width determination unit 203 acquires the roll paper width ID corresponding to the text selected by the user in the roll paper width list box 300, by referring to the roll paper width list 206 illustrated in FIG. 5 stored in the host 1. Next, in step S102, the custom roll paper width determination unit 203 of the printer driver 201 determines whether the roll paper width ID acquired in step S101 is an ID representing the custom roll paper width. More specifically, the custom roll paper width determination unit 203 determines whether "ID_CUSTOM_ROOL" representing the custom roll paper width in FIG. 5 has been acquired in step S101. In a case where it is determined that the ID representing the custom roll paper width has been acquired (YES in step S102), the processing proceeds to step S103.

In step S103, the print data generation unit 204 of the printer driver 201 generates print data having a size corresponding to the custom roll paper width that has been input in the roll paper width edit box 401 illustrated in FIG. 4 and stored in the roll paper width list 206 illustrated in FIG. 5. More specifically, the print data generation unit 204 acquires the data (e.g., document or image) to be printed, from an application via the OS. The data to be printed at this time is, for example, the above-described intermediate data. The print data generation unit 204 then increases or reduces in seize the acquired data to be printed such that a length of the data to be printed in a width direction becomes slightly larger than the roll paper width. Here, an amount of extension, which is an amount of an area that extends off the edges of the roll paper in the width direction (or size of print image) in the data to be printed, is previously defined by the printer driver 201. The data to be printed is increased or reduced in size in step S103 such that the image to be printed extends off the edges of the roll paper in the width direction by the amount of extension. The amount of extension (or size of print image) corresponds to a position at which the ink receiving hole is provided in the printer 2, for each of the roll paper widths compatible with the extension printing.

The roll paper widths that are compatible with the extension printing are those for which a checkmark is set in the "borderless printing (extension printing)" column in the table illustrated in FIG. 7. In other words, for these roll paler widths, the amount of extension (or size of print image) that allows the ink ejected to the area extending off the edges to be accommodated in the ink receiving hole is defined by the printer driver 201.

The print data generation unit 204 then generates the print data (print image) by performing image processing, such as rasterization, color conversion, and binarization on the data increased or reduced in size in the above-described manner. Accordingly, the print data (print image) having the size slightly extending off the edges of the roll paper in the width direction is generated. In other words, the print data (print image) to realize the borderless printing not by the minimum margin printing but by the extension printing, is generated. The print data (print image) generated in step S103, however, is reduced in size by processing described below, and is printed by the minimum margin printing by the printer 2.

Next, in step S104, the print data generation unit 204 of the printer driver 201 includes custom information representing that the roll paper width set as the print setting is the custom roll paper width, to the print command. In the present exemplary embodiment, as the custom information, a variable "customroll" is set to ON ("customroll=ON"), and is included in the print command.

In a case where it is determined in step S102 that the ID acquired in step S101 is not the ID representing the custom roll paper width (NO in step S102), the processing proceeds to step S105.

In step S105, the print data generation unit 204 of the printer driver 201 acquires the "size" corresponding to the roll paper width ID acquired in step S101, from the roll paper width list 206. The print data generation unit 204 then generates print data (print image) having the size corresponding to the roll paper width represented by the "size". The method for generating the print data (print image) here is similar to the method described in step S103. Thus, the detailed description thereof is omitted. Next, in step S106, the print data generation unit 204 imparts a print command representing that the roll paper width set as the print setting is not the custom roll paper width. In the present exemplary embodiment, the above-described variable "customroll" is set to OFF ("customroll=OFF"), and is included in the print command.

The print job including the print data and the print command is generated through the processing of the print data generation unit 204 in steps S103 and S104 or in steps S105 and S106.

Next, in step S107, the print data transmission unit 205 of the printer driver 201 transmits the generated print job to the printer 2 via the OS. The print job here is the one including the print data (print image) generated in step S103 and the print command in which an attribute is included in step S104, or the one including the print data (print image) generated in step S105 and the print command in which the attribute is included in step S106. The print command includes the information representing the print setting set by the printer driver 201. The print setting includes the sheet size information representing the roll paper width and the information representing whether the print setting is the borderless printing. In the processing in FIG. 8, since the "borderless printing" is designated in the print settings, the print job is generated such that the print command includes the information representing the borderless printing.

As described above, the printer driver 201 performs the processing illustrated in FIG. 8 in a case where the borderless printing is set in the print settings. In contrast, in a case where the borderless printing is not set in the print settings, the print data generation unit 204 generates print data (print image) for the bordered printing that has the size corresponding to the roll paper width set in the print setting. The size of the print image has a size including an area for a margin larger than the margin on the sheet in the minimum margin printing. Further, the print data generation unit 204 includes, in the print command, the print data (print image) and the borderless printing setting information representing that the print setting is not the borderless printing. The print job including this print command is then generated, and the print data transmission unit 205 transmits the generated print job to the printer 2.

Figure 9:
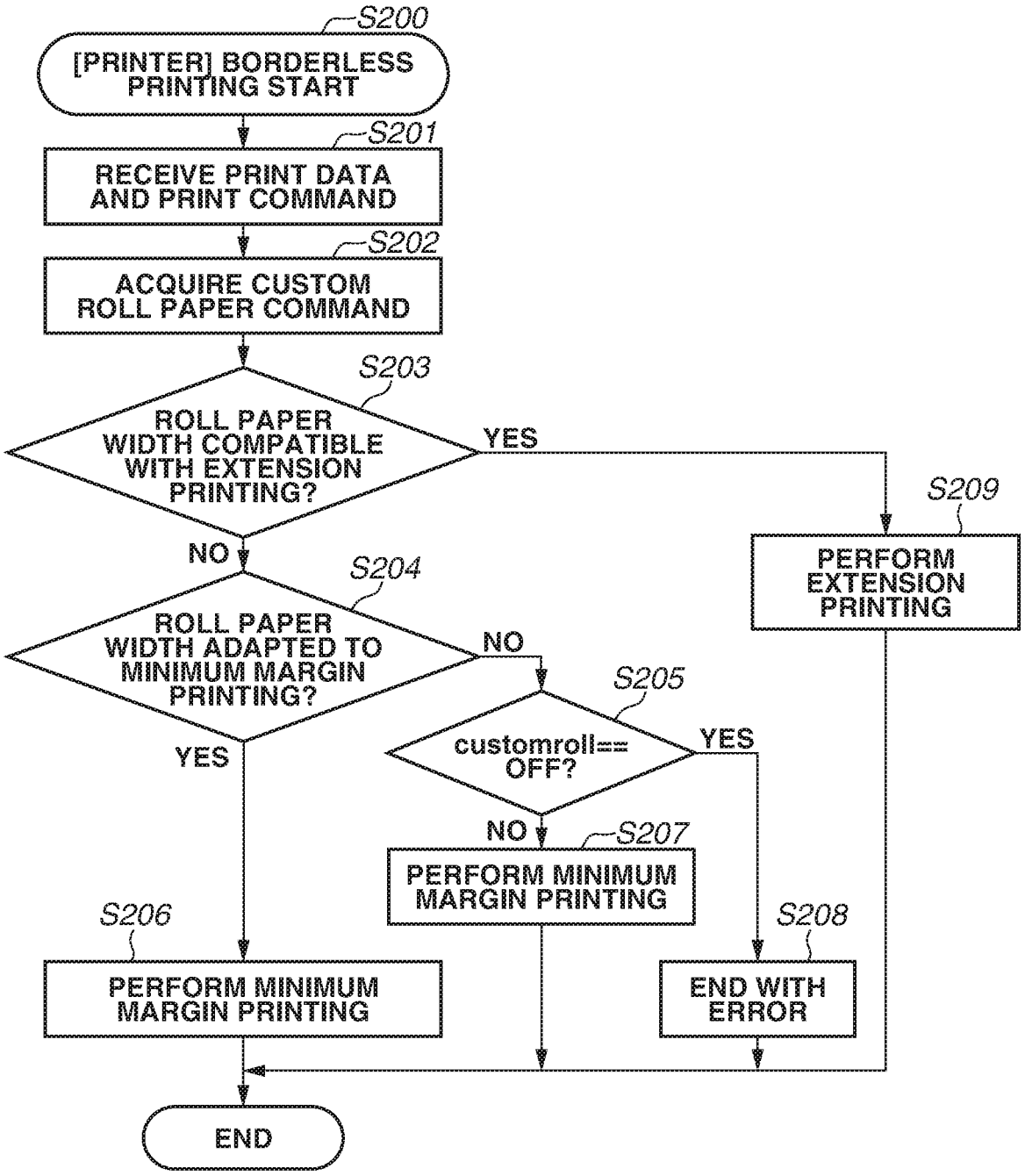
FIG. 9 is a flowchart illustrating an example of processing which is performed by the printer.

Next, a description will be provided of processing which is executed by the printer 2 that has received the print job transmitted from the printer driver 201. FIG. 9 is a flowchart illustrating an example of the processing which is executed by the printer 2 in performing the borderless printing. The processing illustrated in FIG. 9 is realized by the CPU 124 operating as the printer control unit 200. More specifically, the processing illustrated in FIG. 9 is realized by the CPU 124 executing, on the RAM 126, the program stored in the ROM 125. Here, a description will be provided assuming that the printer control unit 200 or each of the functional units of the printer control unit 200 mainly perform the processing.

In step S201, the print data reception unit 209 receives the print job transmitted from the printer driver 201 (host 1). As described above, since the print job includes the print data (print image) and the print command, the print data and the print command are received in step S201.

When receiving the print job in step S201, the printer control unit 200 determines whether the borderless printing has been set by the printer driver 201 by referring to the borderless printing setting information in the print command (not illustrated). In a case where the borderless printing has been set, the printer control unit 200 performs operations in and after step S202. In contrast, in a case where the printing is instructed without designation of the borderless printing, the printer control unit 200 does not perform the operations in and after step S202, and causes the printer engine 122 to print the print data (print image) included in the print job. The sheet on which the border printing has been performed in the above-described manner has a large margin compared with a case where the same data to be printed is printed by the minimum margin printing.

In step S202, the custom roll paper width determination unit 210 determines whether the print command received in step S201 includes the command representing the custom roll paper width. In the present exemplary embodiment, it is determined whether the above-described variable "customroll" has been set to "ON".

Next, in step S203, the printer control unit 200 compares the roll paper width represented by the sheet size information in the print settings of the print job received in step S201 with the borderless printing width list 212 illustrated in FIG. 7. Further, the printer control unit 200 determines whether the roll paper width represented by the sheet size information in the print settings is compatible with the extension printing. More specifically, in a case where a checkmark is set in a field of "borderless printing (extension printing)" column of the borderless printing width list 212 for the roll paper width represented by the print setting, it is determined that the roll paper width is compatible with the extension printing. More specifically, it can be determined that the ink receiving hole is provided at a position corresponding to the roll paper width on the platen. In other words, it is determined that the data slightly larger than the roll paper width is printable for the extension printing.

If it is determined in step S203 that the extension printing is feasible (YES in step S203), the printer control unit 200 causes the printer engine 122 to perform the borderless printing in step S209. Here, the print data (print image) has been already changed in magnification by the printer driver 201, and accordingly has the size that slightly extends off the edges of the roll paper in the width direction and causes the ink ejected to a position beyond the edge to be accommodated in the ink receiving hole. Thus, in step S209, the print data is not changed in magnification for the borderless printing, and the print data is printed.

In contrast, in a case where it is determined in step S203 that the borderless printing is not feasible (in a case where the ink receiving hole is not provided at a position corresponding to roll paper width in print setting) (NO in step S203), the processing proceeds to step S204. In step S204, the printer control unit 200 compares the roll paper width represented by the print settings of the print job received in step S201 with the borderless printing width list 212, and determines whether the roll paper width is compatible with the borderless printing by the minimum margin printing. More specifically, in a case where a checkmark is set in a field of the "minimum margin printing" column of the borderless printing width list 212 for the roll paper width represented by the print setting in a column, it is determined that the roll paper width is compatible with the borderless printing by the minimum margin printing.

In a case where it is determined in step S204 that the borderless printing by the minimum margin printing is feasible (YES in step S204), the printer control unit 200 causes the printer engine 122 to perform the minimum margin printing in step S206. Here, the print data (print image) received in step S201 is generated in step S105 so as to extend off the edges of the roll paper in the width direction; however, the ink receiving hole for such printing is not actually provided. Thus, in step S206, the CPU 124 operating as the printer control unit 200 reduces the print data (print image) in size to the size corresponding to the roll paper width (size same as or slightly smaller than roll paper width), and causes the printer engine 122 to perform printing. Here, the printer control unit 200 may not reduce the print data in size, and the printer engine 122 may cut the end of the print data to obtain the size corresponding to the roll paper width (size same as or slightly smaller than roll paper width), and printing may be performed.

If it is determined in step S204 that the borderless printing by the minimum margin printing is not feasible (in case where a checkmark is set in the corresponding fields in neither the "borderless printing (extension printing)" column nor "minimum margin printing" column in table illustrated in FIG. 7, for roll paper width) (NO in step S204), the processing proceeds to step S205. In step S205, the printer control unit 200 causes the custom roll paper width determination unit 210 to determine whether the variable "customroll" in the print command has been set to "OFF". In a case where the variable "customroll" has been set to "OFF" (YES in step S205), the CPU 124 operating as the printer control unit 200 terminates the processing as error in step S208.

If it is determined in step S205 that the variable "customroll" has been set to "ON" (NO in step S205), the CPU 124 operating as the printer control unit 200 performs, in step S207, the borderless printing by the minimum margin printing in a manner similar to step S206. The processing then ends.

In steps S206, S207, and S209, the printing is started at a leading edge of the sheet in a length direction of the print data (sheet conveyance direction), and the roll paper is cut at a position of a trailing edge of the sheet corresponding to the print data. This makes it possible to perform printing so as not to provide a margin at each of the edges of the cut sheet in the length direction. As described above, for the length direction of the print data, the common printing method and the common cut method are usable for the minimum margin printing and the extension printing in the width direction of the sheet. However, this is not limited thereto, and for example, in the minimum margin printing, a larger margin may be provided in the length direction of the print data.

According to the above-described exemplary embodiment, the user of the host 1 selects the roll paper width in the roll paper width list box 300 illustrated in FIG. 3 displayed by the printer driver 201. Here, even if the ink receiving hole for the selected roll paper width is not provided, the borderless printing is realized by the minimum margin printing (step S206 in FIG. 9).

Further, even in the case where the desired roll paper width is not included in the roll paper width list box 300, the user can select the text "custom size" and designate the desired roll paper width in the dialog illustrated in FIG. 4. Further, even in the case where the text "custom size" is selected and the roll paper width is designated, the printer 2 performs the minimum margin printing (step S207 in FIG. 9). Accordingly, the user can perform the minimum margin printing on the optional roll paper width.

In the above-described exemplary embodiment, the variable "customroll" is set by the printer driver 201, and the printer 2 determines the details of the variable "customroll" in the print command. The variable "customroll", however, may not be included in the print command.

Figure 10:
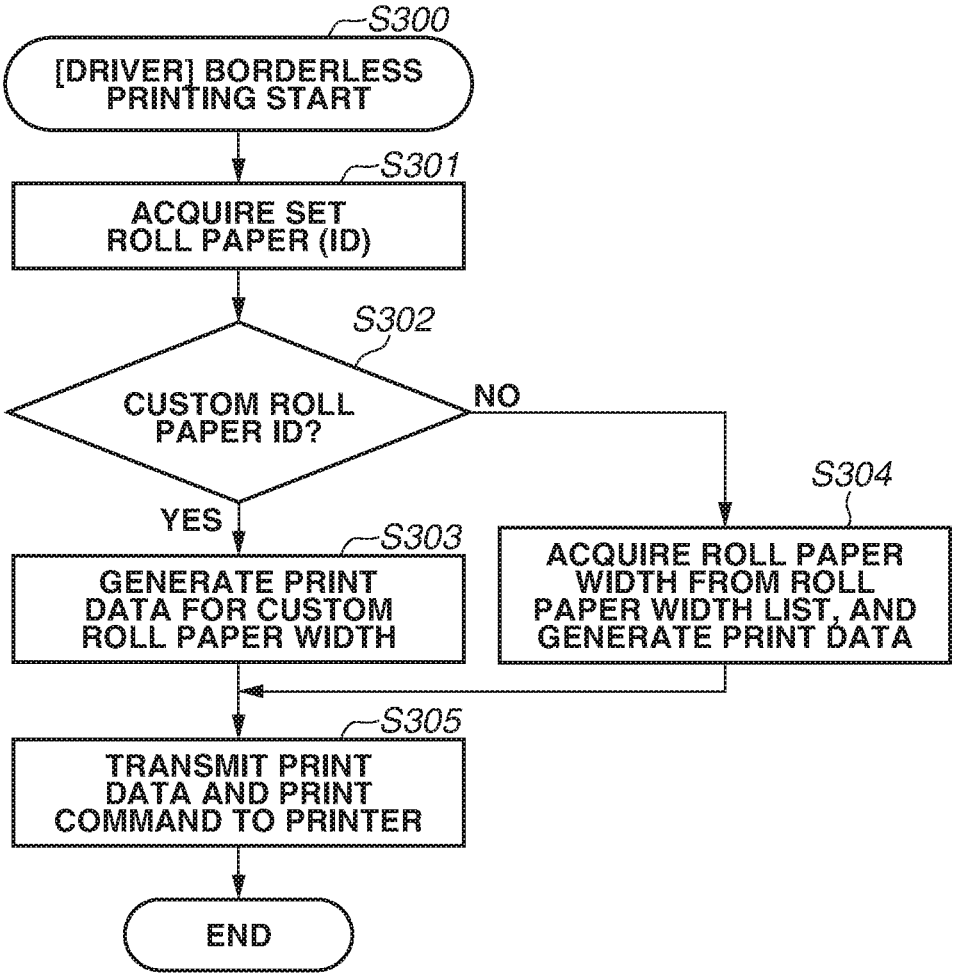
FIG. 10 is a flowchart illustrating another example of the processing which is performed by the printer driver.

FIG. 10 is a flowchart illustrating another example of the processing which is executed by the printer driver in performing the roll paper width enlarged borderless printing. Operations in steps S300 to S304 in FIG. 10 are similar to those in steps S100 to S103 and S105 in FIG. 8. Further, in step S305 of FIG. 10, the print job that includes the print data (print image) and the print command is generated ant transmitted in a manner similar to step S107; however, in step S305, the above-described variable "customroll" is not included in the print command.

Figure 11:
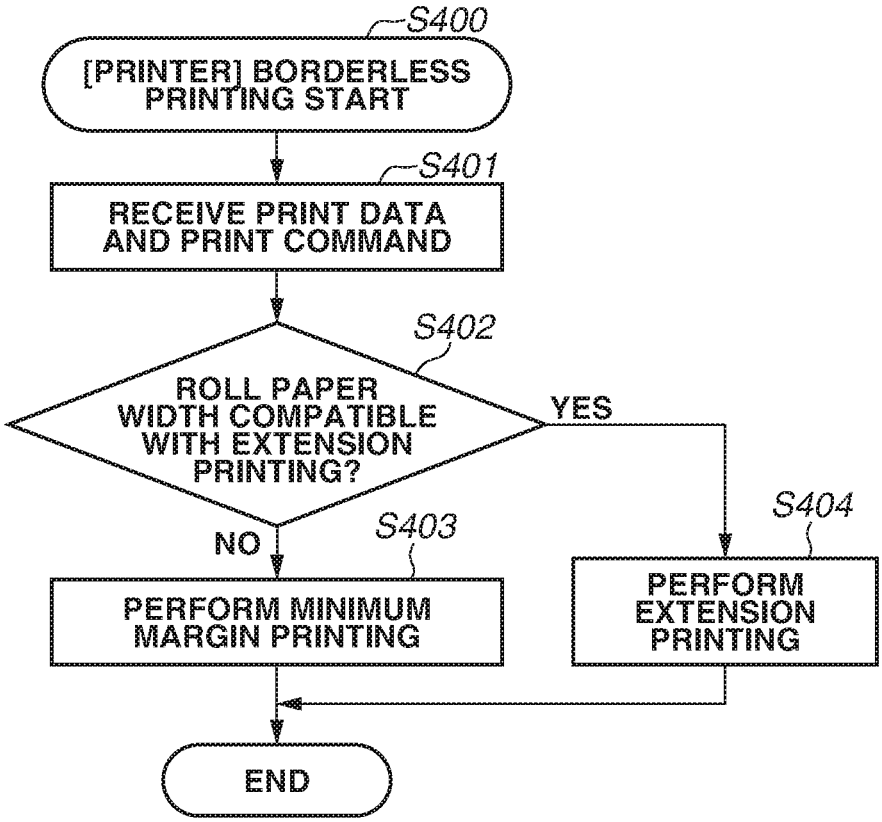
FIG. 11 is a flowchart illustrating another example of the processing which is performed by the printer.

FIG. 11 is a flowchart illustrating another example of the processing which is executed by the printer 2 in performing the roll paper width enlarged borderless printing. Operations in steps S400 to S404 are similar to those in steps S200, S201, S203, S206, and S209 in FIG. 9, and the print job transmitted in step S305 of FIG. 10 is received in step S401.

According to the processing illustrated in FIG. 10 and FIG. 11, the host 1 includes the roll paper width in the print command irrespective of whether the custom size has been selected by the user. Further, when the roll paper width is not compatible with the borderless printing by the extension printing, the printer 2 performs the borderless printing by the minimum margin printing, irrespective of whether the custom size has been selected by the user (step S403 in FIG. 11). The user can perform the borderless printing on the optional roll paper width by the method illustrated in FIG. 10 and FIG. 11.

In the above-described exemplary embodiment, when the printer driver 201 generates the print data (print image), the printer driver 201 generates the print data having the size that is not influenced by whether the roll paper width is compatible with the extension printing or whether the roll paper width is the custom size. More specifically, the print data compatible with the extension printing corresponding to the roll paper width is generated. Thereafter, the printer 2 changes the magnification of the print data based on whether to perform the extension printing or to perform the minimum margin printing. Accordingly, the printer driver 201 can generate the print data without considering whether the roll paper width is compatible with the extension printing and whether the roll paper width is the custom size.

The print data generation method by the printer driver 201 is not limited thereto, and the print data having the transverse width same as that of the roll paper width may be generated irrespective of whether the roll paper width is compatible with the extension printing and whether the roll paper width is the custom size. In the case of the extension printing, the printer 2 performs printing after enlarging the print data. In the case of the minimum margin printing, the printer 2 performs printing without changing the magnification of the print data or performs printing after slightly reducing the print data in size.

Alternatively, the borderless printing width list illustrated in FIG. 7 may be included in the printer driver 201, and the printer driver 201 may generate the print data for extension printing or the print data for the minimum margin printing, based on the roll paper width. More specifically, in the case where the roll paper width is compatible with the extension printing, the printer driver 201 generates the print data so as to extend off the edges of the roll paper in the width direction. Further, in the case where the roll paper width is not compatible with the extension printing but is compatible with the minimum margin printing, or in the case where the roll paper width is the custom size, the printer driver 201 generates the print data having the size corresponding to the minimum margin printing. In this case, the printer 2 prints the print data without changing the magnification of the print data for the borderless printing, thus realizing the extension printing or the minimum margin printing. Here, the borderless printing width list illustrated in FIG. 7 may not be included in the printer 2.

In the above-described exemplary embodiment, the printing on the roll paper has been described; however, the sheet type is not limited thereto, and the processing according to the above-described exemplary embodiment may be applied to printing that is performed on a cut sheet. In such a case, as the sheet size, a plurality of sizes is presented to the user not as the roll paper widths but as the sizes of the cut sheets. The user can designate a transverse width of the cut sheet as the custom size. The extension printing and the minimum margin printing are switched based on whether the size of the cut sheet selected by the user is compatible with the extension printing and whether the size of the cut sheet selected by the user is the custom size. The switching method is similar to the borderless printing processing on the roll paper described above.

In the above-described exemplary embodiment, the processing in step S203 is performed before the determination in step S205 in FIG. 9. Thus, for example, in a case where the roll paper width designated by the user as the custom size is the roll paper width compatible with the borderless printing by the extension printing, the extension printing is performed in step S209 even though the variable "customroll" is set to "ON". Accordingly, it is possible to perform the extension printing in which influence by the conveyance error on the borderless printing is small compared with the minimum margin printing. However, this is not limited thereto, and the minimum margin printing may be performed when the variable "customroll" is set to "ON".

OTHER EMBODIMENTS

Embodiment(s) of the disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-084555, filed Apr. 25, 2019, which is hereby incorporated by reference herein in its entirety.

What is claimed is:

1. A method comprising:

displaying, as first displaying, a plurality of sheet sizes on a display;

displaying, as second displaying, an input screen for inputting a sheet size, on the display;

transmitting, by an information processing apparatus to a printing apparatus, print data and either one of sheet size information about a sheet size selected by a user from among the plurality of sheet sizes displayed in the first displaying and sheet size information about a sheet size input in the input screen displayed in the second displaying; and printing an image based on the transmitted print data, by a printing method for printing to an edge of a sheet, the method being changed based on the transmitted sheet size information, wherein, in a case where sheet size information about a predetermined sheet size selected from among the plurality of sheet sizes is transmitted, an image larger than the predetermined sheet size is printed, based on the print data, and wherein, in a case where the sheet size information about the sheet size input in the input screen is transmitted, an image having a size corresponding to the sheet size information is printed, based on the print data.

2. The method according to claim 1, wherein, also in a case where sheet size information corresponding to a sheet size that is included in the plurality of sheet sizes and is different from the predetermined sheet size is transmitted, an image having a size corresponding to the sheet size information is printed, based on the print data.

3. The method according to claim 1, wherein, in the first displaying, a plurality of display items corresponding to the plurality of sheet sizes, and a predetermined display item are displayed, and wherein, in a case where the predetermined display item is selected by the user, in the second displaying, the input screen is displayed.

4. The method according to claim 3, wherein in the first displaying, a list that includes the plurality of display items and the predetermined display item is displayed.

5. The method according to claim 1, wherein, in a case where the sheet size information about the sheet size input in the input screen corresponds to the predetermined sheet size, in the printing, an image larger than the predetermined sheet size is printed, based on the print data.

6. The method according to claim 1, wherein the information processing apparatus transmits, to the printing apparatus, the print data, the sheet size information, and custom information that represents whether a sheet size corresponding to the sheet size information has been input in the input screen, and wherein the printing apparatus prints an image based on the print data by a printing method that is changed based on the sheet size information and the custom information.

7. The method according to claim 6, wherein, in a case where the sheet size information does not correspond to the predetermined sheet size and the custom information represents that a sheet size corresponding to the sheet size information has been input in the input screen, the printing apparatus prints the image having a size corresponding to the sheet size information, based on the print data.

8. The method according to claim 1, further comprising determining a printing method for printing to an edge of the sheet based on the sheet size information, wherein the printing apparatus prints an image based on the print data by the determined printing method.

9. The method according to claim 1, further comprising generating print data, wherein the information processing apparatus transmits the generated print data.

10. The method according to claim 9, wherein the printing apparatus changes a magnification of the print data based on the transmitted sheet size information, and prints an image based on the print data the magnification of which has been changed.

11. The method according to claim 10, wherein the information processing apparatus generates print data larger than a sheet size corresponding to the transmitted sheet size information, wherein, in a case where the sheet size information about the predetermined sheet size is transmitted in the transmitting, the printing apparatus does not change the magnification of the print data in the printing, and wherein, in a case where the sheet size information about the sheet size input in the input screen is transmitted in the transmitting, the printing apparatus reduces the print data in size in the printing, wherein, in a case where the sheet size information about the sheet size input in the input screen is transmitted, the printing apparatus reduces the print data in size in the printing.

12. The method according to claim 10, wherein the information processing apparatus generates print data of a sheet size corresponding to the transmitted sheet size information, wherein, in a case where the sheet size information about the predetermined sheet size is transmitted, the printing apparatus enlarges the print data in the printing, and wherein, in a case where the sheet size information about the sheet size input in the input screen is transmitted, the printing apparatus does not change the magnification of the print data.

13. The method according to claim 1, wherein, in a case where the sheet size information about the sheet size input in the input screen is transmitted, the image is printed, with a margin, on a sheet size corresponding to the sheet size information.

14. The method according to claim 1, wherein the printing apparatus prints the image on roll paper, and wherein the plurality of sheet sizes is a plurality of roll paper widths of the roll paper, and the input screen is a screen for inputting a roll paper width.

15. The method according to claim 1, wherein, in a case where printing to an edge of the sheet has been set in the information processing apparatus, printing in the printing is performed, and wherein, in a case where printing to an edge of the sheet has not been set in the information processing apparatus, the printing apparatus performs printing so as to provide, on the sheet, a margin larger than a margin for a case where the sheet size information about the sheet size input in the input screen is transmitted.

16. The method according to claim 15, wherein the information processing apparatus further transmits, to the printing apparatus, setting information representing whether printing to an edge of the sheet has been set in the information processing apparatus, and wherein, in a case where the transmitted setting information represents printing to an edge of the sheet, the printing apparatus performs the printing in the printing.

17. A system including an information processing apparatus and a printing apparatus that prints an image on a sheet, wherein the information processing apparatus comprises a first display unit configured to display a plurality of sheet sizes on a display, a second display unit configured to display an input screen for inputting a sheet size, on the display, and a transmission unit configured to transmit, to the printing apparatus, print data and either one of sheet size information about a sheet size selected by a user from among the plurality of sheet sizes displayed by the first display unit and sheet size information about a sheet size input in the input screen displayed by the second display unit, wherein the printing apparatus comprises a printing unit configured to print an image based on the transmitted print data, by a printing method for printing to an edge of the sheet, the printing method being changed based on the transmitted sheet size information, wherein, in a case where sheet size information about a predetermined sheet size selected from the plurality of sheet sizes is transmitted, the printing unit prints an image larger than the predetermined sheet size, based on the print data, and wherein, in a case where the sheet size information about the sheet size input in the input screen is transmitted, the printing unit prints an image having a size corresponding to the sheet size information, based on the print data.

18. An apparatus that communicates with an information processing apparatus and prints an image on a sheet, the information processing apparatus comprising a first display unit configured to display a plurality of sheet sizes on a display, a second display unit configured to display an input screen for inputting a sheet size, on the display, and a transmission unit configured to transmit print data and either one of sheet size information about a sheet size selected by a user from among the plurality of sheet sizes displayed by the first display unit and sheet size information about a sheet size input in the input screen displayed by the second display unit, the printing apparatus comprising a printing unit configured to print an image based on the transmitted print data, by a printing method for printing to an edge of the sheet, the printing method being changed based on the transmitted sheet size information, wherein, in a case where sheet size information about a predetermined sheet size selected from the plurality of sheet sizes is transmitted, the printing unit prints an image larger than the predetermined sheet size, based on the print data, and wherein, in a case where the sheet size information about the sheet size input in the input screen is transmitted, the printing unit prints an image having a size corresponding to the sheet size information, based on the print data.

19. The apparatus according to claim 18, wherein, in a case where sheet size information corresponding to a sheet size that is included in the plurality of sheet sizes and is different from the predetermined sheet size is transmitted, an image having a size corresponding to the sheet size information is printed, based on the print data.

20. The apparatus according to claim 18, wherein a plurality of display items corresponding to the plurality of sheet sizes, and a predetermined display item are displayed in the first display unit, and wherein, in a case where the predetermined display item is selected by the user, the input screen is displayed in the second display unit.

* * * * *